US008002900B2

(12) United States Patent
Le Roux

(10) Patent No.: US 8,002,900 B2
(45) Date of Patent: Aug. 23, 2011

(54) METHOD AND APPARATUS FOR AUTOMATED CLEANING OF BOTTLING EQUIPMENT

(76) Inventor: Etienne Le Roux, Paarl (ZA)

( * ) Notice: Subject to any disclaimer, the term of this patent is extended or adjusted under 35 U.S.C. 154(b) by 342 days.

(21) Appl. No.: 12/063,112

(22) PCT Filed: Jan. 25, 2006

(86) PCT No.: PCT/ZA2006/000012

§ 371 (c)(1),
(2), (4) Date: Jul. 14, 2008

(87) PCT Pub. No.: WO2007/019590

PCT Pub. Date: Feb. 15, 2007

(65) Prior Publication Data

US 2008/0302392 A1 Dec. 11, 2008

(30) Foreign Application Priority Data

Aug. 8, 2005 (ZA) ..... 2005/06319

(51) Int. Cl.
*B08B 3/02* (2006.01)
*B08B 3/04* (2006.01)
*B08B 9/032* (2006.01)

(52) U.S. Cl. ..... 134/22.11; 134/22.18; 134/23; 134/25.1; 134/25.5; 134/32; 134/137; 134/166 R; 134/171; 134/167 R; 134/199; 134/22.12; 134/167 C; 134/238; 134/15.05; 134/15.06; 222/148; 141/90; 141/91

(58) Field of Classification Search ..... 134/22.12, 134/22.18, 24, 25.1, 25.5, 43, 166 C; 141/90, 141/91; 222/148; 137/238, 240, 15.01, 15.05
See application file for complete search history.

(56) References Cited

U.S. PATENT DOCUMENTS 4,024,896 A * 5/1977 Ishioka et al. ..... 141/90
4,414,036 A * 11/1983 Anderson et al. ..... 134/23
5,533,552 A 7/1996 Ahlers

FOREIGN PATENT DOCUMENTS

DE 3722495 A1 1/1989

(Continued)

OTHER PUBLICATIONS

Machine translation of Jp 08-217198 to Tsukano et al., 1996.*

(Continued)

*Primary Examiner* — Michael Barr
*Assistant Examiner* — Natasha Campbell
(74) *Attorney, Agent, or Firm* — Connolly Bove Lodge & Hutz LLP

(57) ABSTRACT

A method and apparatus 30 are provided for cleaning of bottle filling equipment 10 that has a plurality of elevated valves 18, each valve being in flow communication with filling liquid supply means 14. The method includes storing a manifold 32 that has a plurality of cleaning openings 42 in a configuration resembling that of the valves, in a position that allows clear visibility and access to the operation of the valves. The manifold 32 is lowered relative to the valves 18, so that it is below the valves and is positioned underneath the valves, with each cleaning opening 42 in flow communication with a valve. The valves 18 are rinsed with liquid flowing through the filling liquid supply 14, the valves and the manifold 32. Afterwards, the manifold 32 is removed from the valves 18 and returned to its stored position.

21 Claims, 8 Drawing Sheets

FOREIGN PATENT DOCUMENTS

| | | | | |
|---|---|---|---|---|
| DE | 4343425 | A1 | | 6/1995 |
| FR | 2810634 | A1 | | 12/2001 |
| JP | 08217198 | A | * | 8/1996 |
| JP | 11091877 | A | | 4/1999 |

OTHER PUBLICATIONS

Communication from Australian Government dated Jul. 29, 2009 in corresponding Application No. 2006278243.

* cited by examiner

METHOD AND APPARATUS FOR AUTOMATED CLEANING OF BOTTLING EQUIPMENT

RELATED APPLICATIONS

This application is a national stage application (under 35 U.S.C. §371) of PCT/ZA2006/000012 filed Jan. 25, 2006, which claims benefit of South African application 2005/06319 filed Aug. 8, 2005, disclosure of which is incorporated herein by reference.

FIELD OF THE INVENTION

THIS INVENTION relates to automated bottle filling equipment. In particular, the invention relates to a method and apparatus for automated cleaning of bottle filling equipment, in place.

BACKGROUND TO THE INVENTION

Equipment used to fill bottles or similar containers with liquids usually need to be cleaned from time to time. This is particularly important where the liquids are beverages for human consumption and some of these beverages such as fruit juices and dairy products, are particularly prone to contamination and/or degradation. Accordingly, it is generally accepted good practice to wash all the equipment that comes into contact with these beverages at regular intervals of about eight hours of continuous machine operation, once a shift, daily, etc.

Where large numbers of bottles or similar containers need to be filled with liquids, this can be done efficiently by filling the bottles under gravity from an overhead reservoir through a number of bottle filling valves, while the bottles are supported on pedestals underneath the valves. This technique is applied in most large scale bottle filling applications in machines called "rotary fillers" which have a number of circumferentially spaced pedestals, each underneath a corresponding valve that is fed from an overhead reservoir. The pedestals, valves and reservoir rotate together and each bottle is received on a pedestal, is lifted to open its valve, is filled, is lowered, and is removed from its pedestal, all within one rotation of the rotary filler.

Rotary fillers typically include a large number of bottle filling valves and each valve is typically complicated in structure, with the result that thorough cleaning of the valves is time consuming, reducing the productive availability of the equipment.

In order to reduce the time required for cleaning rotary fillers, each of the valves can be rinsed with water, detergents, solvents, and/or the like, in place, from within the overhead reservoir and/or from the discharge of the valve, towards the reservoir. If the valves are rinsed from the inside of the reservoir, a trough or similar collecting vessel can be placed underneath the valves, to collect the rinsing liquid.

Alternatively, a number of valves can be rinsed simultaneously by placing a manifold underneath the valves, lifting the manifold to open the valves, and rinsing the valves simultaneously from within the reservoir and/or rinsing them simultaneously from the manifold. Manifolds of this kind, used for cleaning bottle filling valves in place (referred to as "cleaning in place manifolds" or abbreviated to "cip manifolds") are typically large and heavy, since they need to be structurally rigid enough not to flex when they are lifted to open the valves and they need to be large enough to allow a large stream of rinsing liquid to flow inside them. The space around rotary fillers is usually quite constrained due to ancillary equipment, but in order to avoid having to carry the cip manifolds far, they are typically kept close to the rotary fillers, where they are in the way and often cause nuisance, discomfort, or even injury. The cumbersome size, heavy weight, and complicated geometry of cip manifolds make it difficult to store and handle them and the difficulty is aggravated by the need to keep the path of the bottles in the rotary filler highly visible and accessible, to allow continuous visual monitoring of the filling operation and rapid corrective action, when required.

The object of the present invention is to provide a method and apparatus for automated cleaning of bottle filling equipment, particularly valves, in place, allowing a number of valves to be cleaned simultaneously by rinsing from the overhead tank and/or from a cip manifold, with minimal operator involvement and without significantly obstructing visibility or accessibility of the bottle filling process.

BRIEF DESCRIPTION OF THE INVENTION

According to one aspect of the present invention there is provided a method for cleaning of bottle filling equipment including a plurality of elevated valves that are each in flow communication with filling liquid supply means, said method comprising:

- supporting a manifold adjacent the equipment in a position that allows clear visibility and access to the operation of the valves, said manifold defining a plurality of cleaning openings;
- positioning the manifold relative to the valves, so that the manifold is at a height below the heights of the valves;
- positioning the manifold underneath the valves, with each cleaning opening in flow communication with a valve;
- rinsing at least some of the valves with liquid flowing through the filling liquid supply, the valves and the manifold; and
- removing the manifold from the valves.

The filling liquid supply means may include an elevated reservoir with the valves provided below the reservoir and the position adjacent the equipment where the manifold is supported according to the method, may be adjacent the filling liquid supply means, e.g. adjacent the reservoir. Alternatively, the manifold may be stored at a position that is lower than the valves, e.g. adjacent a base of the bottle filling equipment.

The step of positioning the manifold relative to the valves at a height below the heights of the valves, may comprise lowering the manifold and/or lifting the valves. The valves may be attached to the reservoir and may be lifted by lifting the reservoir.

The step of positioning the manifold underneath the valves may comprise pivoting the manifold about an upright axis.

The valves may be opened to achieve flow communication with the cleaning openings, by moving a lower part of each valve upwardly relative to the rest of the valve. This may be done by lifting the manifold to press the lower parts of the valves upwardly and/or by lowering the valves relative to the manifold.

The valves may be rinsed with liquid flowing from the reservoir, through the valves and into the manifold and/or with liquid flowing in the opposite direction. Preferably, the liquid will repeatedly, consecutively flow in the one direction and then in the other.

The method may comprise returning the manifold to the position adjacent the reservoir, e.g. by reversing at least some of the movements of the manifold.

More than one manifold may be used in the method and the method may involve cleaning all the valves simultaneously.

The method may be automated in whole or in part and some of the method steps may be performed continually and/or simultaneously.

According to a further aspect of the present invention there is provided apparatus for cleaning of bottle filling equipment including a plurality of elevated valves, each being in flow communication with filling liquid supply means, said apparatus comprising:

at least one manifold defining a plurality of cleaning openings, spaced apart in a configuration resembling the configuration of the valves;

support means for supporting the manifold adjacent the bottle filling equipment in a position that allows clear visibility and access to the operation of the valves;

means for positioning the manifold relative to the valves, so that the manifold is at a height below the heights of the valves;

means for positioning the manifold underneath the valves, with each cleaning opening in flow communication with a valve; and means for supplying a cleaning liquid to at least one of the manifold and the filling liquid supply means.

The filling liquid supply means may comprise an elevated reservoir and the valves may be provided below the reservoir.

The support means may be configured to support the manifold adjacent the filling liquid supply means, e.g. adjacent the reservoir. Alternatively, the support means may be configured to support the manifold below the elevation of the valves, e.g. adjacent a base of the bottle filling equipment.

The manifold supporting means may be height adjustable and/or the apparatus may include height adjustable support means, supporting the valves, e.g. height adjustable support means supporting the reservoir and its attached valves.

The manifold may be pivotally supported on its support means, to pivot about an upright axis. Preferably, two manifolds may be pivotally attached to their support means to pivot generally symmetrically to their respective positions, below the valves.

BRIEF DESCRIPTION OF THE DRAWINGS

For a better understanding of the present invention, and to show how the same may be carried into effect, reference will now be made, by way of non-limiting example, to the accompanying drawings in which:—

DETAILED DESCRIPTION OF THE DRAWINGS

Figure 1:
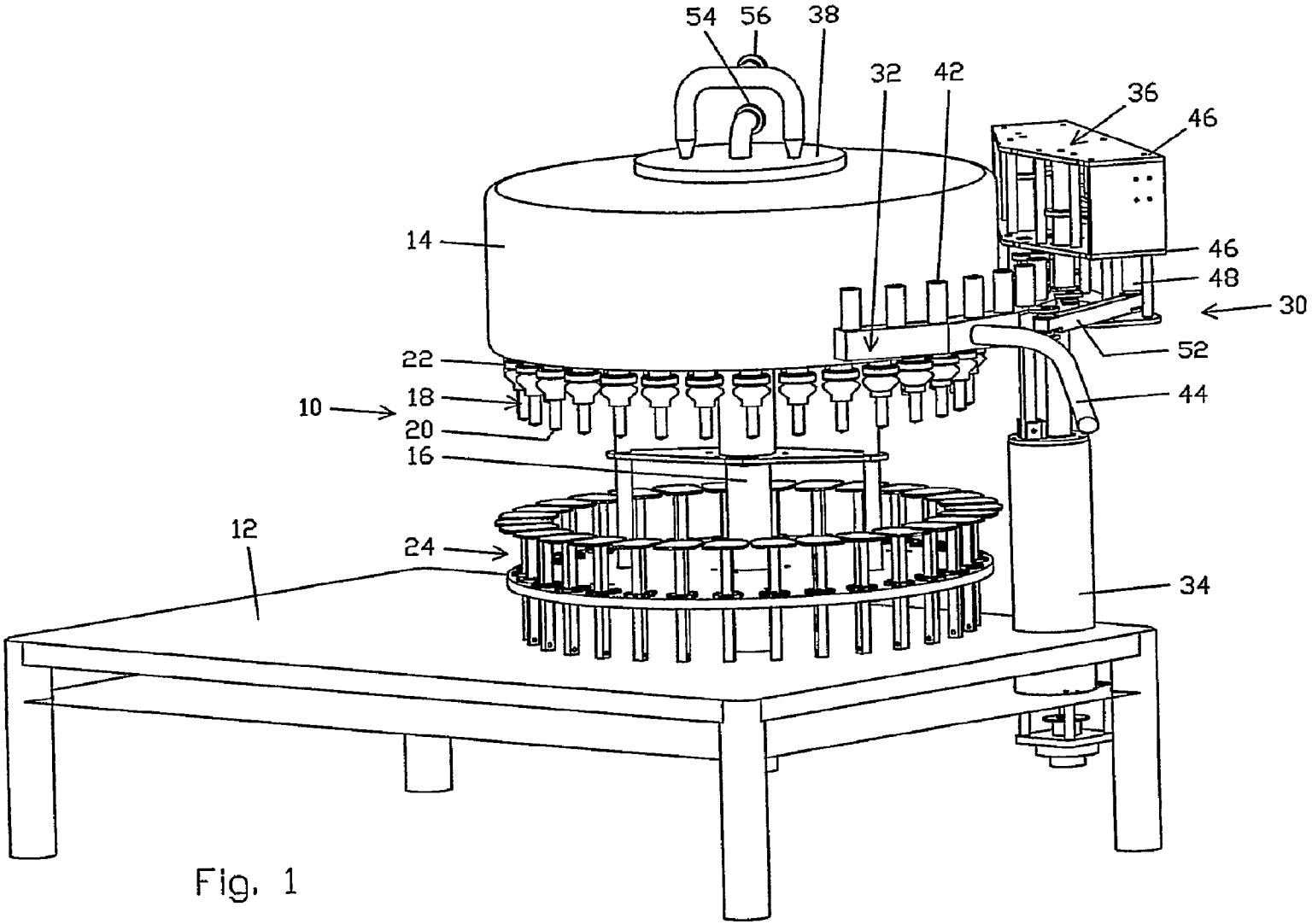
FIG. 1 is a three-dimensional side view of a rotary filler with cleaning apparatus in accordance with the present invention, in a first position.

Referring to the drawings, a rotary filler is shown including many features known in the prior art and is generally indicated by reference numeral 10.

The rotary filler 10 is supported on a table 12 and includes filling liquid supply means in the form of a reservoir 14 that is round in plan view, supported high above the table on reservoir support means in the form of a central post 16. Thirty two bottle filling valves 18 are attached to the underside of the reservoir 14 in a circumferentially spaced arrangement and are in flow communication with the cavity inside the reservoir. Each valve 18 has a discharge nozzle 20 at its lower end, that is connected by bellows 22 to the rest of the valve, so that the valve opens when the nozzle is moved upwards, relative to the rest of the valve.

The valves 18 are so-called "level filling" valves that are well known in the art and that stop filling depending on liquid levels relative to the elevations of openings/passages. This type of valve 18, that opens when contact with a bottle to be filled moves the nozzle 20 upwards, falls into a category known as "contact" valves, but the invention is equally applicable for use in relation to "non-contact" type valves, which have nozzles that open and close under automatic control without contacting the bottles, e.g. while weighing a bottle being filled on an electronic scale. The nozzles of non-contact valves need to be cleaned inside and outside, similar to contact valves.

Thirty two bottle pedestals 24 are supported in a circular arrangement above the table 12 and each pedestal is vertically displaceable by a cam mechanism (not shown). The reservoir 14, valves 18 and pedestals 24 are connected together to rotate at the same rate and each pedestal is kept generally underneath one of the valves.

Cleaning apparatus in accordance with the present invention is generally indicated by reference numeral 30 and includes two cip manifolds 32, each pivotally attached to support means in the form of an upright cylinder 34 extending from the table 12 and a crank assembly 36, at the top of the cylinder. The apparatus 30 also includes a cover 38 that is receivable in a top opening of the reservoir 14.

Each manifold 32 includes an elongate, curved, hollow body 40 from which eight hollow spigots 42 extend upwardly, each defining a cleaning opening of the manifold. The spigots 42 are spaced apart in a curved configuration resembling the configuration of the valves 18 in that it has the same pitch diameter and the same spacing. A flexible hose 44 is attached to the body of each manifold at its one end, the other end being attachable to other equipment (see below). The internal cavity of the hollow body 40 is sealed, apart from being in flow communication with each of the spigots 42 and with the hose 44.

The term "pitch diameter" refers to the diameter of an imaginary circle on which the centres of a number of articles is situated.

The crank assembly 36 includes three horizontal plates 46, spaced above one another, with two crank mechanisms for the manifolds generally housed between the lower two plates and actuating crank cylinders 50 generally housed between the upper two plates. Each crank mechanism includes a cylindrical pivot bush 48 that can pivot about a vertical axis, and a crank arm (not shown) that is fixedly attached to the bush and is actuated by its associated cylinder 50 in crank fashion, to pivot the bush about its axis. Each bush 48 is fixedly attached to a pivot arm, which is attached to its associated manifold 32.

The two crank assemblies are mirror images of each other and are configured to pivot the manifolds 32 between outer positions (shown in FIGS. 1 to 4) and inner positions (shown in FIGS. 5 to 8) in which the spigots 42 of both manifolds are positioned in a circumferential arrangement with a pitch radius of all the spigots generally equal to the common pitch radius of the valves 18 and the pedestals 24.

The cover 38 is removably fitted in a sealing manner in the upper opening of the reservoir 14 on a slip ring of high density polyethylene (HDPE) and includes a central product inlet pipe 54 and a forked cip pipe assembly 56 with two spray balls (not shown) attached to it, inside the cavity of the reservoir. The product inlet pipe 54 is connectable to a supply of liquid with which bottles can be filled in the rotary filler 10, while the cip pipe assembly 56 is connectable to a supply or discharge of cleaning liquid (see below).

Cylinder 34 is configured to move the crank assembly 36 and consequently the attached manifolds 32, vertically. A similar cylinder arrangement (not shown) is provided to move the reservoir 14 and attached valves 18 vertically. It is to be understood that the powered movements described herein with reference to cylinders, cranks, etc, can be achieved in other ways, without departing from the scope of the invention.

The movement of all the components of the rotary filler 10 and the cleaning apparatus 30 is controlled automatically by control equipment as is known in the art.)

Figure 2:
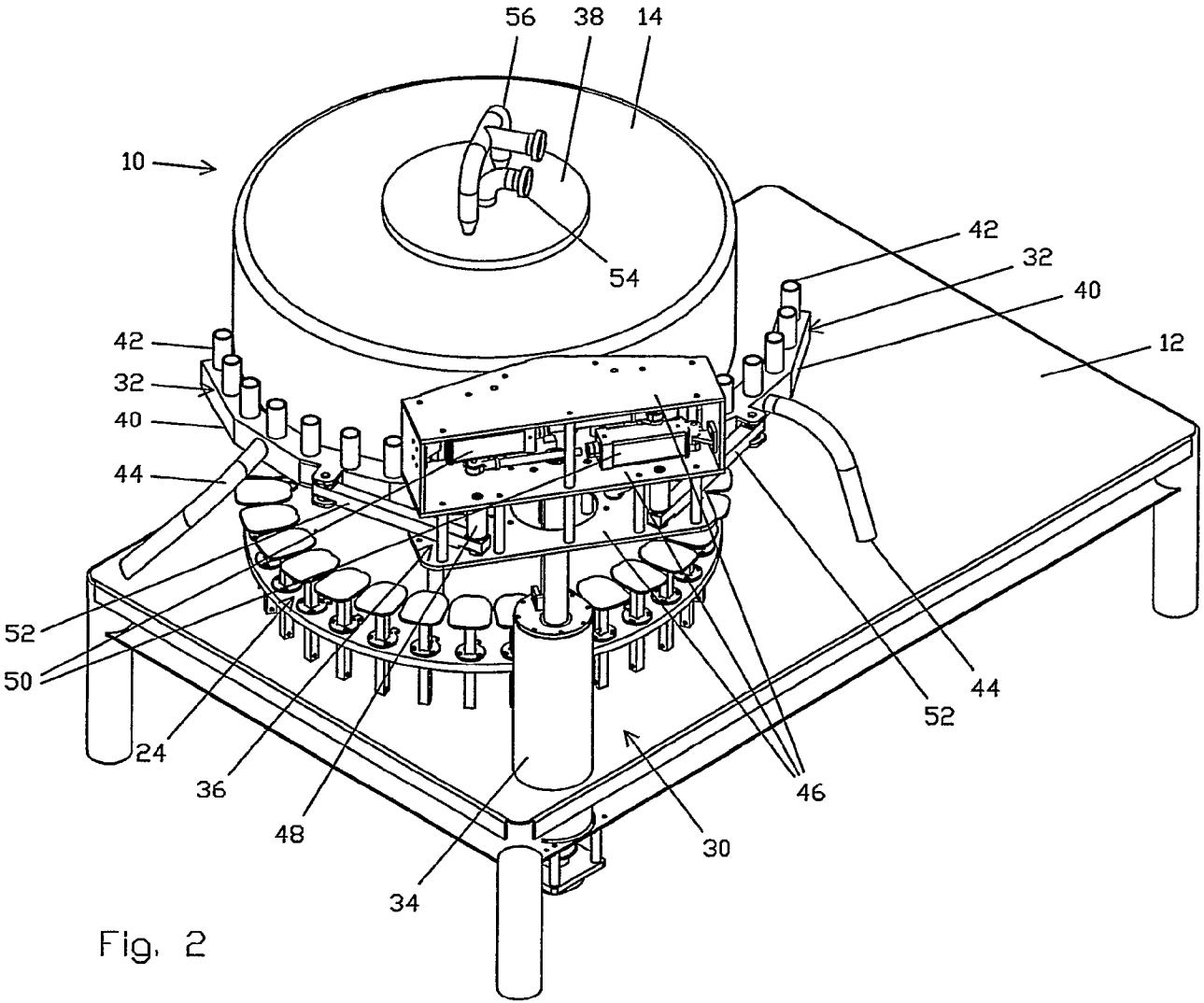
FIG. 2 is a three-dimensional top view of the rotary filler and cleaning apparatus of FIG. 1.

Referring to FIGS. 1 and 2, while the rotary filler 10 is in use in the conventional way, the manifolds 32 are pivoted outwardly so that they can extend on the outside of the reservoir 14 and the cylinder 34 is extended to lift the manifolds to the position shown, next to the reservoir. In this position, the manifolds 32 are out of the way and the pedestals 24 and valves 18 are easily visible and accessible.

When the reservoir 14 and valves 18 have been in use and need to be cleaned, the reservoir is emptied/drained and the pedestals 24 are cleared of any bottles.

The manifolds 32 are lowered by the cylinder 34 to a position shown in FIGS. 3 and 4, where the manifolds are at a height below the valves 18. At the same time, the reservoir 14 and valves 18 are lifted by the cylinder of the central post 16, to provide a large enough space to fit the manifolds between the valves and the pedestals 24. It is to be understood that, depending on the size and configuration of the rotary filler 10 and apparatus 30, it may be sufficient either to lift the reservoir 14 or to lower the manifolds 32. Further, it is possible to configure the pedestals 24 to be lowered, to provide space for the manifolds 32.

Figure 5:
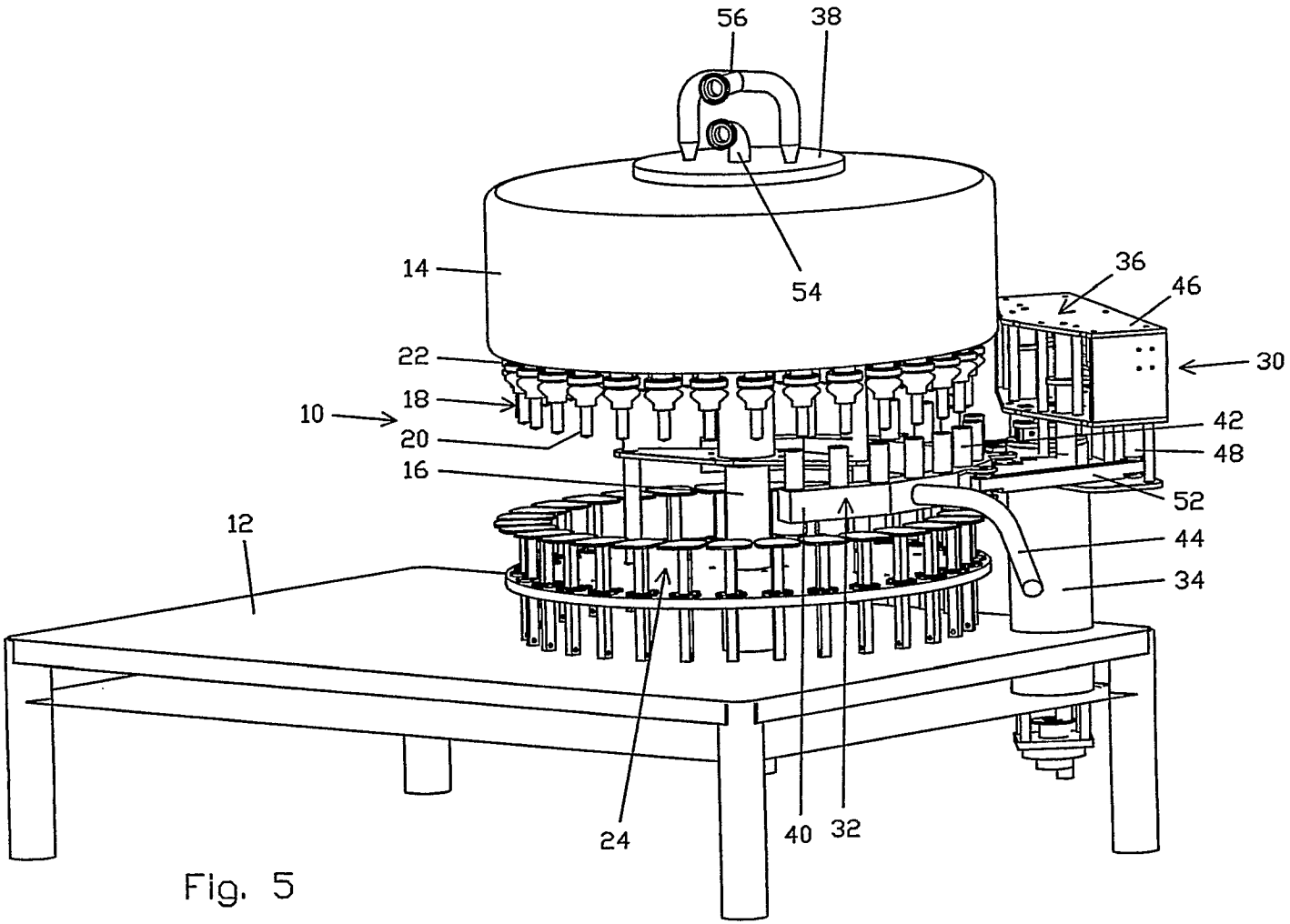
FIG. 5 is a three-dimensional side view of the rotary filler and cleaning apparatus of FIG. 1, in a third position.
Figure 6:
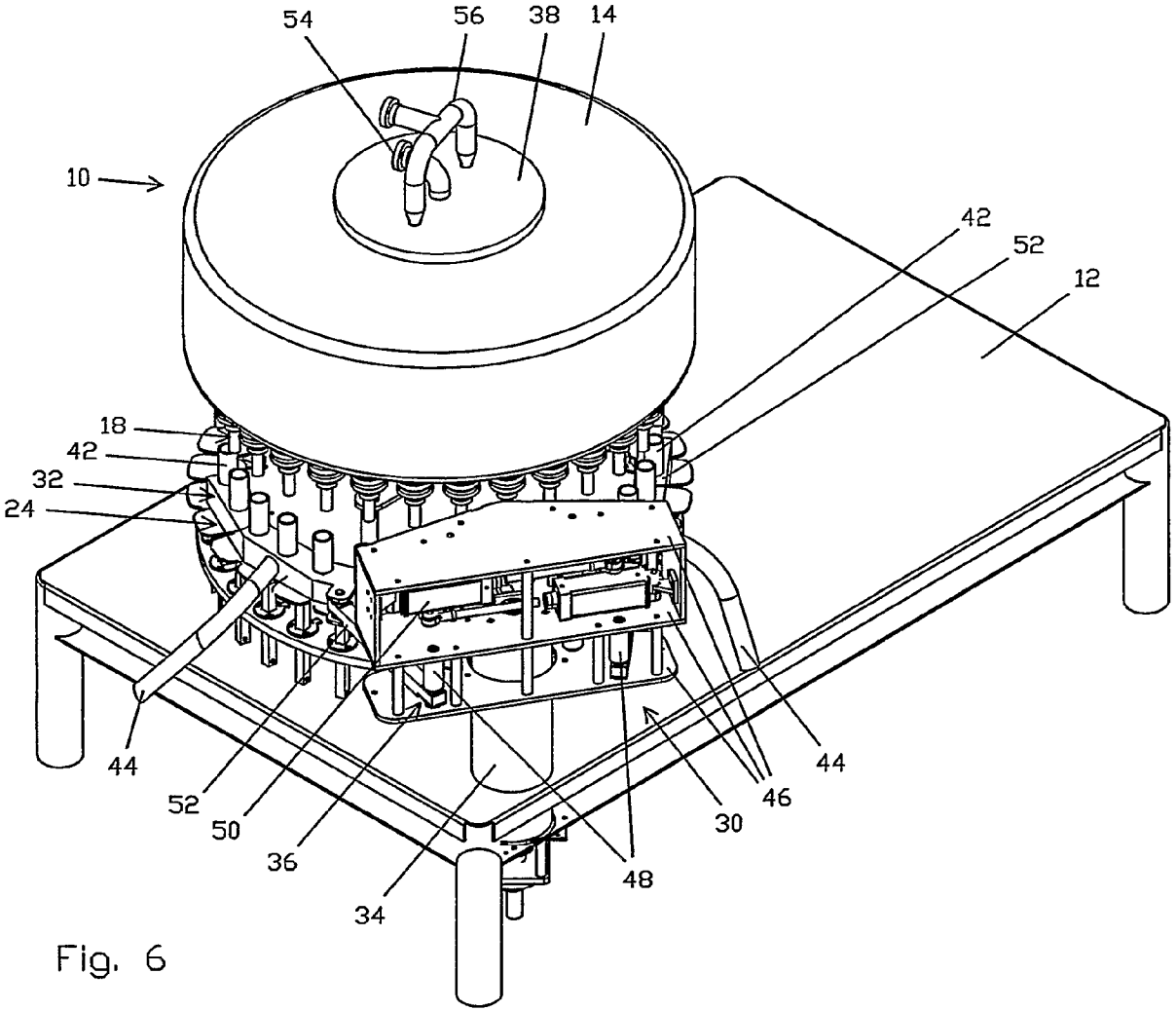
FIG. 6 is a three-dimensional top view of the rotary filler and cleaning apparatus of FIG. 5.

The manifolds 32 are positioned underneath the valves 18 by pivoting them to their inner positions as shown in FIGS. 5 and 6. If necessary, the reservoir 14 is rotated about its vertical axis until a valve 18 is aligned with the cleaning opening of each spigot 42.

Figure 7:
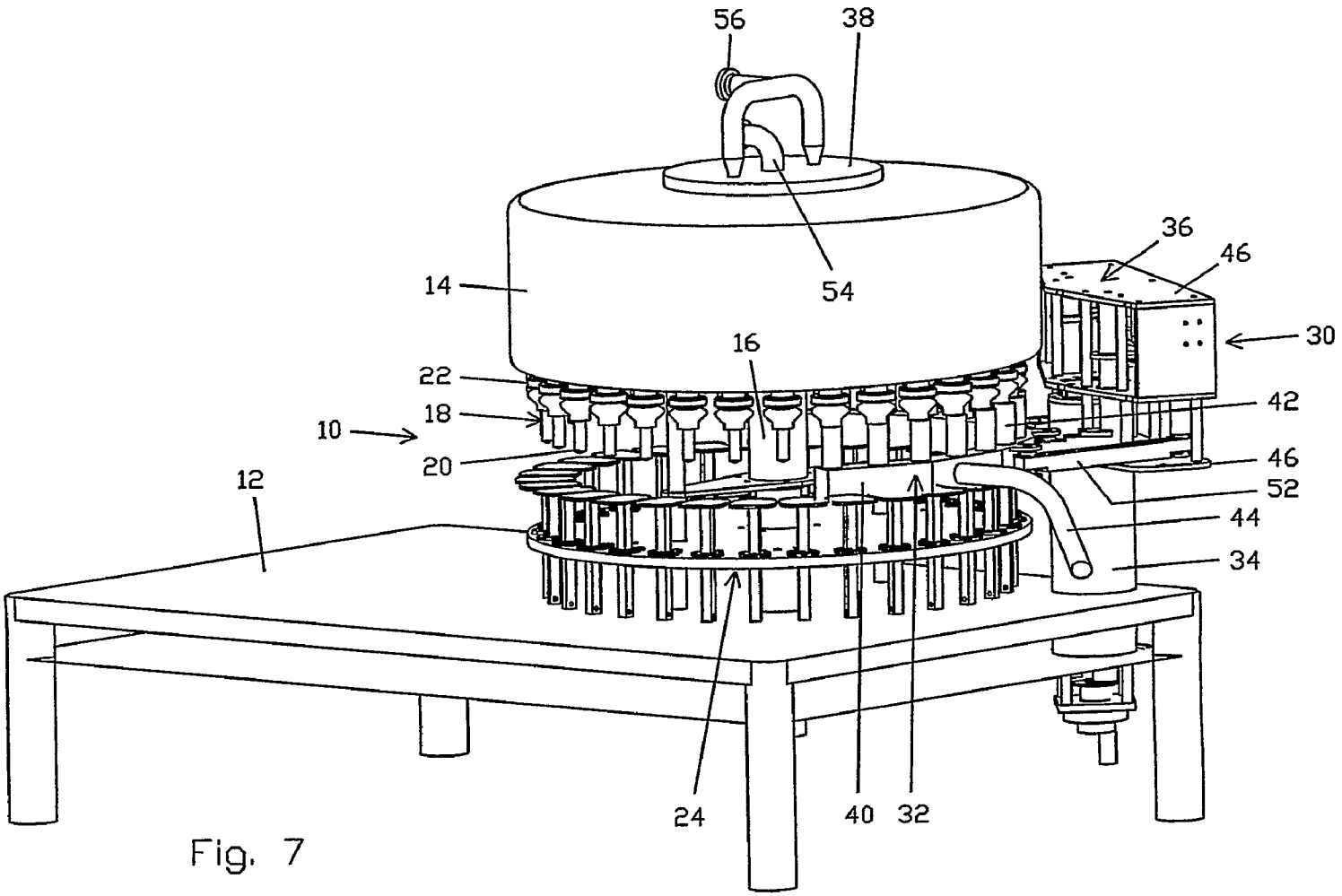
FIG. 7 is a three-dimensional side view of the rotary filler and cleaning apparatus of FIG. 1, in a fourth position.
Figure 8:
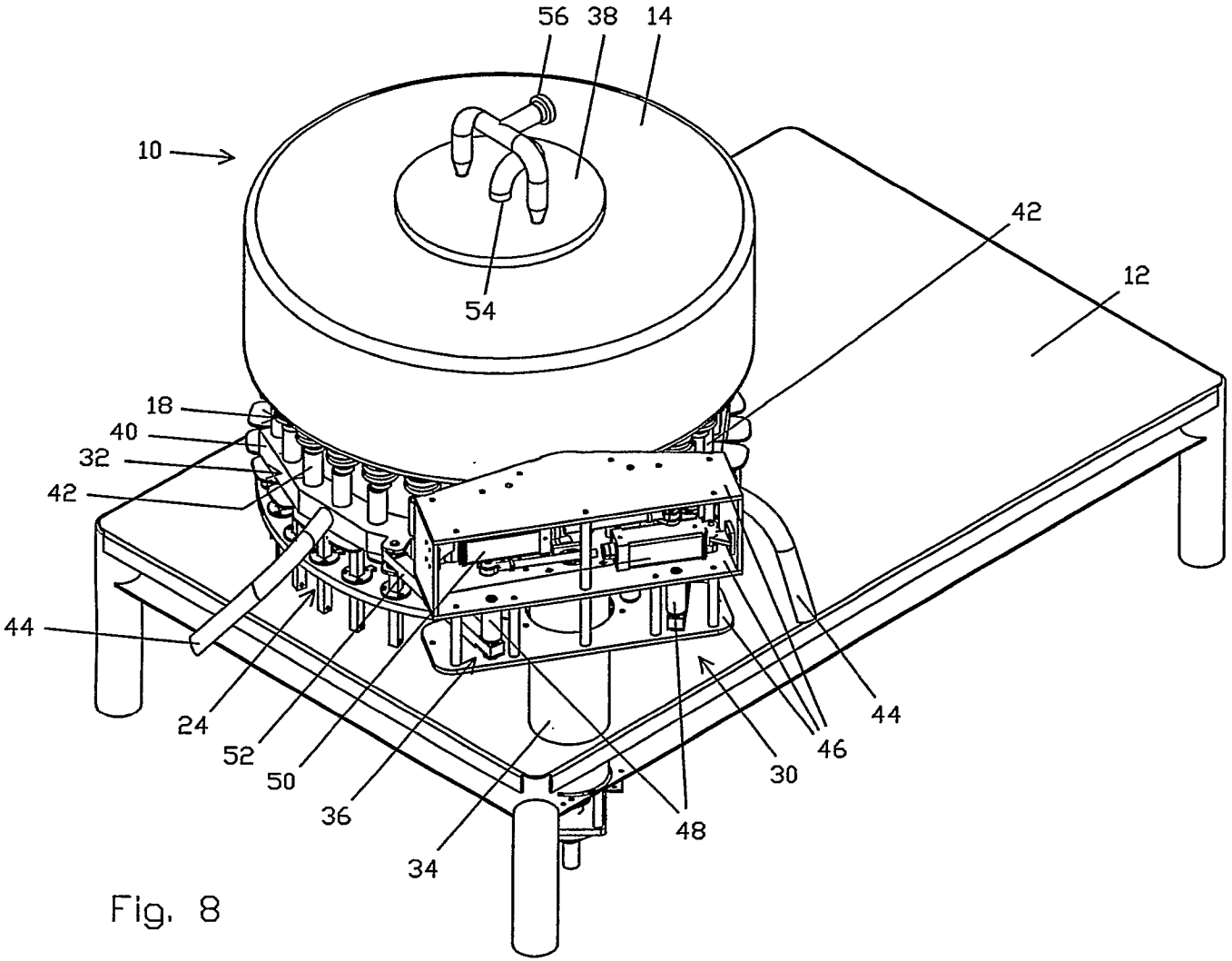
FIG. 8 is a three-dimensional top view of the rotary filler and cleaning apparatus of FIG. 7.

Once aligned, the manifolds 32 are lifted by the cylinder 34 so that the nozzle 20 of each of the valves 18 that is aligned with a spigot 42 is received within the spigot and is pushed upwardly so that the valve is opened and is in flow communication with the cleaning opening, as shown in FIGS. 7 and 8. Instead of or in addition to lifting the manifolds 32, the reservoir 14 and valves 18 can be lowered relative to the manifolds.

The reservoir 14 and valves 18 are cleaned by repeatedly rinsing them consecutively in an "upward" fashion and a "downward" fashion, with a cleaning liquid including diluents, solvents, detergents, and/or the like.

To rinse in an upward fashion, the hoses 44 are connected to a supply of the cleaning liquid under pressure, so that the liquid flows under pressure into the cavities of the manifolds 32, around the nozzles 20, upwardly through the valves 18, including their vents (if any), and into the reservoir 14. The liquid is removed from the reservoir 14 via the cip pipe assembly 56.

To rinse in a downward fashion, the cip pipe assembly 56 is connected to the supply of the cleaning liquid and the liquid is sprayed into the reservoir via the spray balls, from where it flows under gravity and/or pressure along a flow path opposite to that described in respect of upward rinsing, until it is drained out of the manifolds 32 via the hoses 44.

Depending on operational requirements, it may be sufficient to rinse only upwardly or downwardly.

Figure 3:
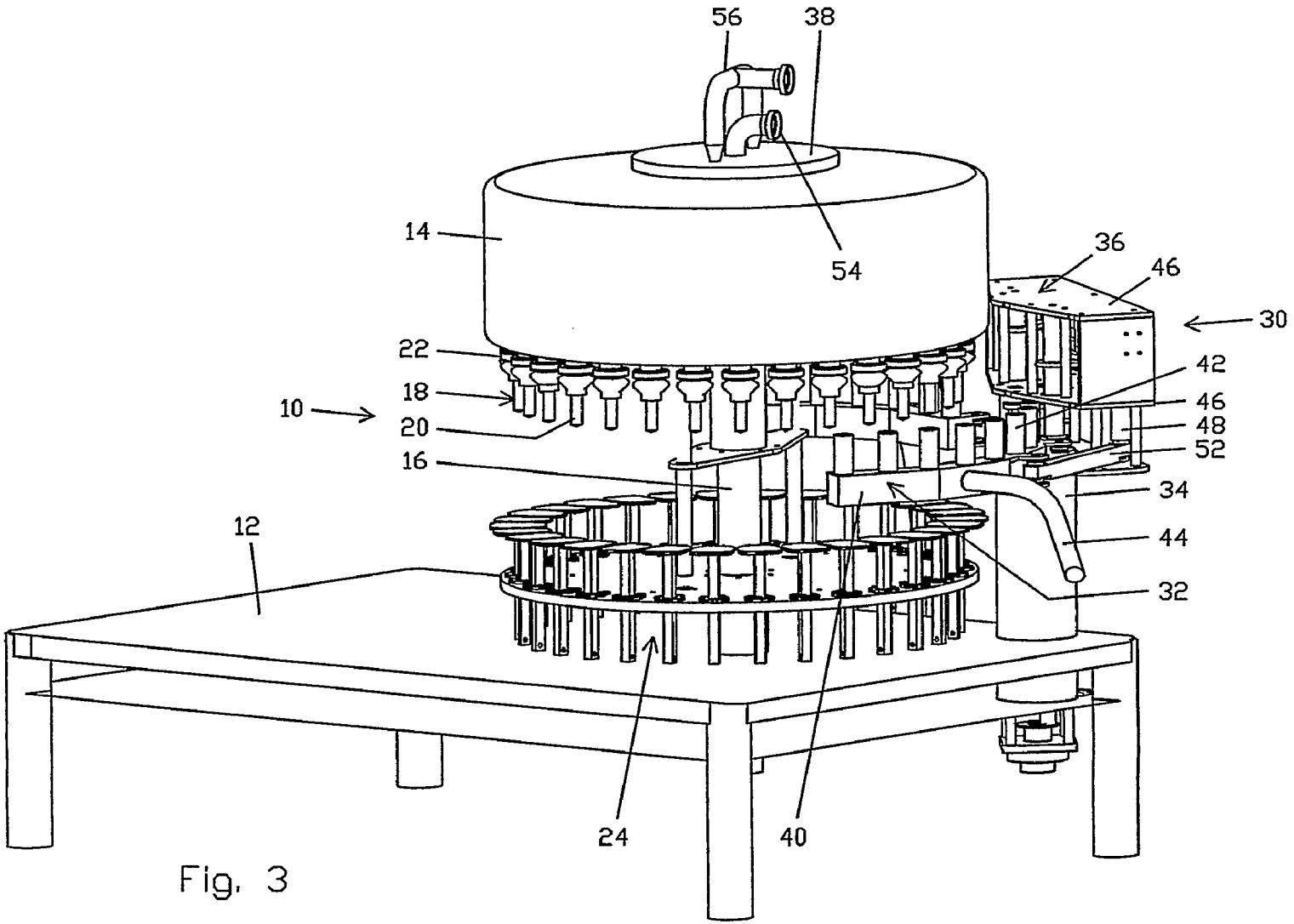
FIG. 3 is a three-dimensional side view of the rotary filler and cleaning apparatus of FIG. 1, in a second position.
Figure 4:
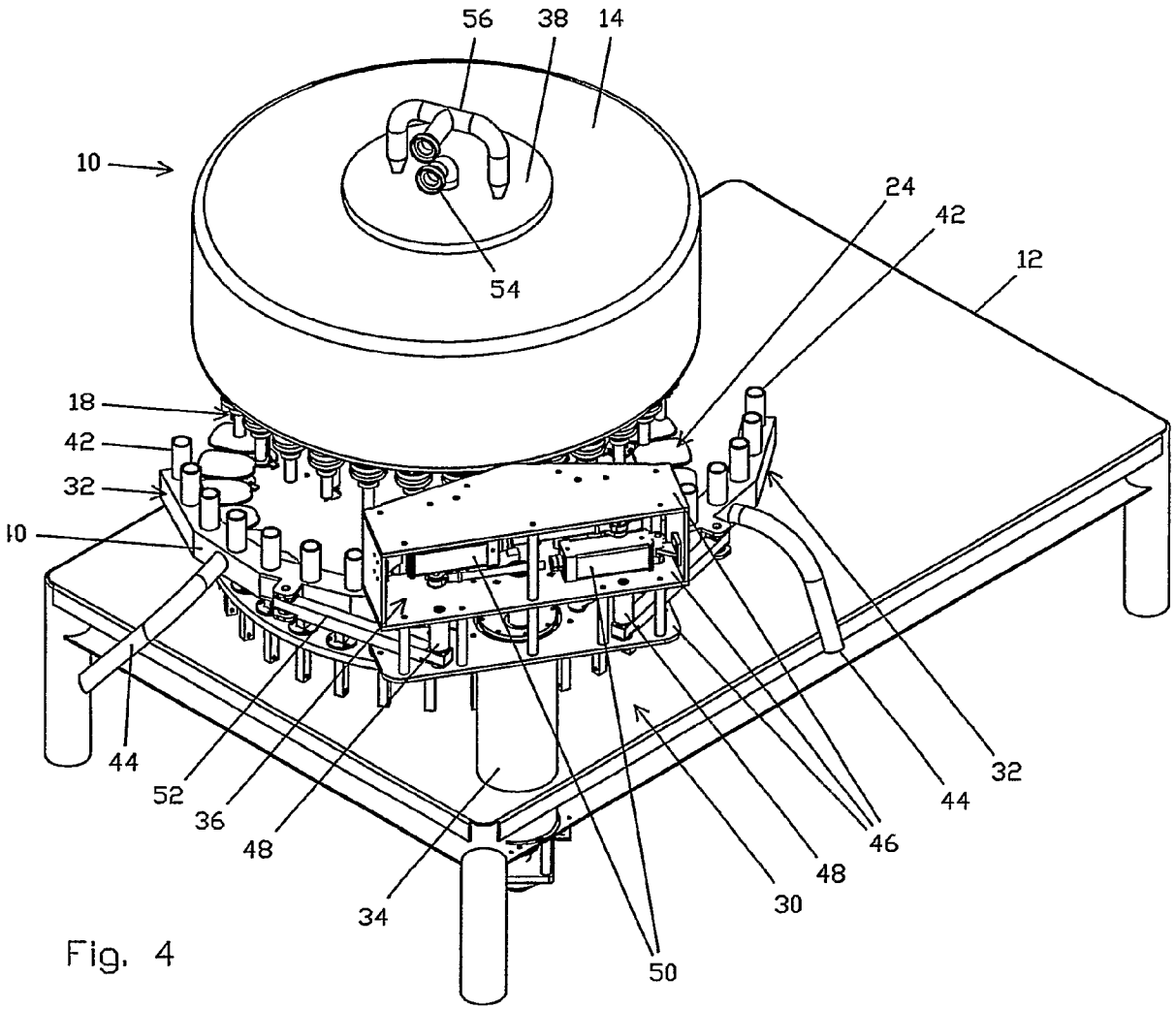
FIG. 4 is a three-dimensional top view of the rotary filler and cleaning apparatus of FIG. 3.

After the reservoir 14 and valves 18 have been rinsed, the manifolds 32 are lowered and/or the reservoir and valves are lifted, to withdraw the nozzles 20 from the spigots 42, to the position shown in FIGS. 5 and 6, the manifolds are pivoted outwardly to the position shown in FIGS. 3 and 4, and are lifted to the position shown in FIGS. 1 and 2, whereafter the rotary filler 10 can be returned to service.

In other embodiments of the invention the manifolds 32 are configured to allow simultaneous cleaning of all the valves 18 of the particular rotary filler 10. Depending on the size of the rotary filler 10 and the number of valves, it may be necessary to provide more than one cylinder 34 and crank assembly 36, at different positions around the filler and/or to provide more pivoted or hinged manifolds 32.

Further, in another embodiment of the invention that is not illustrated, instead of storing the manifolds 32 at an elevated position, next to the reservoir 14 or other means for supplying filling liquids to the valves 18, the manifolds can be stored at a lower elevation, e.g. next to a base, such as the table 12. The manifold 32 will then have to be lifted automatically, positioned under the valves 18, lifted to contact the valves, etc., the rest of the operation being the same as in the embodiment described above.

The invention illustrated holds the advantages of allowing a number of bottle filling valves to be cleaned simultaneously by rinsing from the overhead reservoir and/or from the cip manifold, without the need to handle the manifold and without significantly obstructing visibility or accessibility of the bottle filling process.

The invention claimed is:

1. A method for cleaning of bottle filling equipment including a plurality of elevated, circumferentially spaced valves that are each in flow communication with filling liquid supply means , said method comprising:

supporting a rigid manifold adjacent the equipment in a stationary stored position radially outside from the rotary bottle filling equipment, but at an elevation that allows clear visibility and access to the operation of the valves, said manifold defining a plurality of cleaning openings;

positioning the manifold relative to the valves, so that the manifold is at a height below the heights of the valves;

positioning the manifold underneath the valves, with each cleaning opening in flow communication with a valve;

rinsing at least some of the valves with liquid flowing through the filling liquid supply, the valves and the manifold; and removing the manifold from the valves, characterised in that the filling liquid supply means includes an elevated reservoir with the valves provided below the reservoir and the stored position adjacent the equipment where the manifold is supported according to the method, is at an elevation above the valves, adjacent the filling liquid supply means and positioning the manifold relative to the valves at a height below the heights of the valves, includes lowering the manifold.

2. A method for cleaning of bottle filling equipment including a plurality of elevated, circumferentially spaced valves that are each in flow communication with filling liquid supply means, said method comprising:

supporting a rigid manifold adjacent the equipment in a stationary stored position radially outside from the rotary bottle filling equipment, but at an elevation that allows clear visibility and access to the operation of the valves, said manifold defining a plurality of cleaning openings;

positioning the manifold relative to the valves, so that the manifold is at a height below the heights of the valves;

positioning the manifold underneath the valves, with each cleaning opening in flow communication with a valve;

rinsing at least some of the valves with liquid flowing through the filling liquid supply, the valves and the manifold; and removing the manifold from the valves, characterised in that positioning the manifold relative to the valves at a height below the heights of the valves, comprises lifting the valves.

3. A method as claimed in claim 2, characterised in that the valves are attached to the filling liquid supply means and are lifted by lifting the filling liquid supply means.

4. A method as claimed in claim 1, characterised in that positioning the manifold underneath the valves comprises pivoting the manifold about an upright axis that is disposed radially outside from the rotary bottle filling equipment.

5. A method as claimed in claim 1, characterised in that the valves are opened to achieve flow communication with the cleaning openings, by moving a lower part of each valve upwardly relative to the rest of the valve.

6. A method as claimed in claim 5, characterised in that the lower part of each valve is moved upwardly relative to the rest of the valve by lifting the manifold to press the lower parts of the valves upwardly.

7. A method as claimed in claim 5, characterised in that the lower part of each valve is moved upwardly relative to the rest of the valve by lowering the valves relative to the manifold.

8. A method as claimed in claim 1, characterised in that the valves are rinsed with liquid flowing from the filling liquid supply means, through the valves and into the manifold.

9. A method as claimed in claim 1, characterised in that the valves are rinsed with liquid flowing from the manifold, through the valves and into the filling liquid supply means.

10. A method as claimed in claim 1, characterised in that the valves are rinsed with liquid flowing repeatedly, consecutively from the manifold, through the valves and into the filling liquid supply means and then in the opposite direction.

11. A method as claimed in claim 1, characterised in that the method comprises returning the manifold to the position adjacent the bottle filling equipment.

12. A method as claimed in claim 1, characterised in that more than one manifold is used in the method.

13. A method as claimed in claim 1, characterised in that the method involves cleaning all the valves simultaneously.

14. A method as claimed in claim 1, characterised in that the method is automated, at least in part.

15. A method as claimed in claim 1, characterised in that at least some of the method steps are performed immediately after a preceding step, without interruption.

16. A method as claimed in claim 1, characterised in that the at least some of the method steps are performed simultaneously.

17. Apparatus for cleaning of bottle filling equipment, said apparatus including a plurality of elevated, circumferentially spaced valves that are each in flow communication with filling liquid supply means, said filling liquid supply means comprising an elevated reservoir and the valves being provided below the reservoir, and said apparatus comprising:

at least one rigid manifold defining a plurality of cleaning openings, spaced apart in a configuration resembling the configuration of the valves;

support means for supporting the manifold adjacent the bottle filling equipment in a stationary, stored position radially outside from the rotary bottle filling equipment, but at an elevation that allows clear visibility and access to the operation of the valves;

means for positioning the manifold relative to the valves, so that the manifold is at a height below the heights of the valves;

means for positioning the manifold underneath the valves, with each cleaning opening in flow communication with a valve; and means for supplying a cleaning liquid to at least one of the manifold and the filling liquid supply means, characterised in that the support means is configured to support the manifold in its stored position adjacent the filling liquid supply means above the elevation of the valves.

18. Apparatus as claimed in claim 17, characterised in that the manifold supporting means is height adjustable.

19. Apparatus as claimed in claim 17, characterised in that the apparatus includes height adjustable support means, supporting the valves.

20. Apparatus as claimed in claim 17, characterised in that the manifold is pivotally supported on its support means, to pivot about an upright axis that is disposed radially outside from the rotary bottle filling equipment.

21. Apparatus as claimed in claim 20, characterised in that two manifolds are pivotally attached to their support means to pivot generally symmetrically to their respective positions, below the valves.

* * * * *